US006105183A

United States Patent [19]

Bly

[11] Patent Number: 6,105,183

[45] **Date of Patent: *Aug. 22, 2000**

[54] REVERSIBLE TRANSFER BENCH

[75] Inventor: Robert R. Bly, Wellington, Ohio

[73] Assignee: Invacare Corporation, Elyria, Ohio

[ * ] Notice: Under 35 U.S.C. 154(b), the term of this patent shall be extended for 528 days.

[21] Appl. No.: 08/540,095

[22] Filed: Oct. 6, 1995

[51] Int. Cl.[7] ..... A47K 3/12

[52] U.S. Cl. ..... 4/579; 4/578.1; 297/94

[58] Field of Search ..... 4/560.1, 578.1, 4/579; 297/94, 283.3, 383, 440.2

[56] References Cited

U.S. PATENT DOCUMENTS

| | | | |
|---|---|---|---|
| D. 347,526 | 6/1994 | Hamilton | D6/335 |
| 2,784,769 | 3/1957 | Fisher | 297/383 X |
| 3,191,992 | 6/1965 | McMasters | 297/440.2 X |
| 4,253,203 | 3/1981 | Thomas | 4/560.1 X |
| 4,359,791 | 11/1982 | Thomas | 4/560.1 X |
| 4,391,006 | 7/1983 | Smith | 4/559 |
| 4,472,844 | 9/1984 | Mace | 4/579 |
| 4,475,256 | 10/1984 | Hatala | 4/562.1 |
| 4,520,515 | 6/1985 | Hatala | 4/579 |
| 4,975,991 | 12/1990 | Peterson | 4/579 |
| 5,335,377 | 8/1994 | Masyada et al. | 4/578.1 |
| 5,361,428 | 11/1994 | Nanowsky et al. | 4/558 |

OTHER PUBLICATIONS

Activeaid Publication—Model 277 "Tub/Commode Chair", 2 pp., 1989.

*Primary Examiner*—Robert M. Fetsuga
*Attorney, Agent, or Firm*—Hudak & Shunk Co., L.P.A.

[57] ABSTRACT

A transfer bench facilitates assembly and allows for ease of reversibility. Particularly, a seat has a seat portion secured to a frame assembly. A seat back is removably connected to the seat and frame assembly depending on whether the bathtub is a right-hand or left-hand tub. A preferred arrangement is to use a pair of L-shaped members, one leg of which receives the seat back and the second leg of which extends through openings in the seat portion. Spring biased snap buttons snap fit in place and removably secure the seat back to the remainder of the transfer bench.

12 Claims, 2 Drawing Sheets

REVERSIBLE TRANSFER BENCH

BACKGROUND OF THE INVENTION

This invention pertains to the art of patient care products and more particularly to a transfer bench. The invention is applicable to a reversible transfer bench that easily converts the bench for use in either in a right-hand or left-hand bathtub and will be described with particular reference thereto. However, it will be appreciated that the invention has broader applications and may be advantageously employed in similar patient care environments and applications.

Known transfer benches typically comprise a frame assembly that is either free standing or secured to a tub sidewall. For example, a free standing transfer bench positions a pair of support legs within the bathtub and another pair of support legs outboard of the tub. Secured transfer benches, on the other hand, use a clamp assembly that grips interior and exterior surfaces of the tub sidewall and the support frame is disposed entirely or primarily in the tub. The support legs, either adjustable or fixed height legs, locate a seating surface of the transfer bench at a predetermined height above the tub floor, i.e., at a height just slightly greater than the height of the tub sidewall. This allows a user/patient positioned on the seating surface outside of the tub to slide over the tub sidewall to a location within the tub. Additionally, an end of the frame is provided with a handrail that extends upwardly from the frame and above the seating surface to be selectively grasped by a user/patient.

A common construction for the seating surface employs individual plastic seat elements that are secured to the frame assembly. For example, three generally equally sized seat portions are mounted in side-by-side fashion to define the seating surface of the transfer bench. Each of the seat elements is fixedly secured to the frame assembly and, likewise, a seat back is fixedly secured with fasteners (such as screws) relative to the seating surface.

Typically, the faucet and hot and cold water control valves are disposed on one of the end walls of the tub. Accordingly, the bath and shower controls are classified as either right-hand or left-hand depending on the location of the shower controls relative to the sidewall that the transfer bench traverses. Additionally, transfer benches are typically shipped to a dealer for assembly and display to potential customers. In other instances, the transfer bench is shipped directly to an end user. In either event, assembly is required to position the seat back, handrail, etc. to the frame. Even though instructions are provided, dealers or end users may inadvertently and improperly assemble the transfer bench to meet the needs of a particular bathtub, i.e., right-hand or left-hand, when the tub is just the opposite from the assembled arrangement. It is, then, necessary to disassemble the transfer bench and rearrange the individual components to match the user's bathtub configuration.

Aside from the possibility that the bench may be improperly assembled, it also requires an undesirable amount of time to complete the assembly. End users do not care to assemble the transfer bench, even if provided with proper instructions. Similarly, dealers who are well versed at assembling patient care products do not wish to be troubled with assembly. Accordingly, a transfer bench that has minimal assembly and yet is still easily shipped will prove to be more marketable.

Among the prior patents that clamp transfer benches to a sidewall of the tub are U.S. Pat. Nos. 4,475,256; 4,520,515; 4,391,006; 5,361,428; and 4,472,844. A free-standing transfer bench is shown in D347,526.

SUMMARY OF THE INVENTION

The present invention contemplates a new and improved transfer bench that is reversible, easy to assemble, and overcomes the above-referenced problems and others.

According to the present invention, a preferred transfer bench includes a frame assembly having a seat portion fixed thereto. A seat back is removably connected to the seat portion and may be alternatively mounted to accommodate a right-hand or left-hand bathtub.

According to another aspect of the invention, a pair of L-shaped members are secured to the seat back and adapted for removable connection with the seat portion.

According to another aspect of the invention, each of the L-shaped members includes a biased snap button that extends outwardly therefrom and prevents the seat back from being removed from or mounted to the seat portion unless the snap buttons are depressed.

A principal advantage of the invention resides in the ease with which the end user can assemble the transfer bench.

Another advantage of the invention is the ability to easily reverse the transfer bench for use with either a right-hand or left-hand tub.

Yet another advantage is the provision of a one-piece bench seat that accommodates both right-hand and left-hand tub configurations and significantly saves on molding costs relative to individual seat elements that are separately secured to the frame.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein.

DETAILED DESCRIPTION OF THE PREFERRED EMBODIMENT

Figure 1:
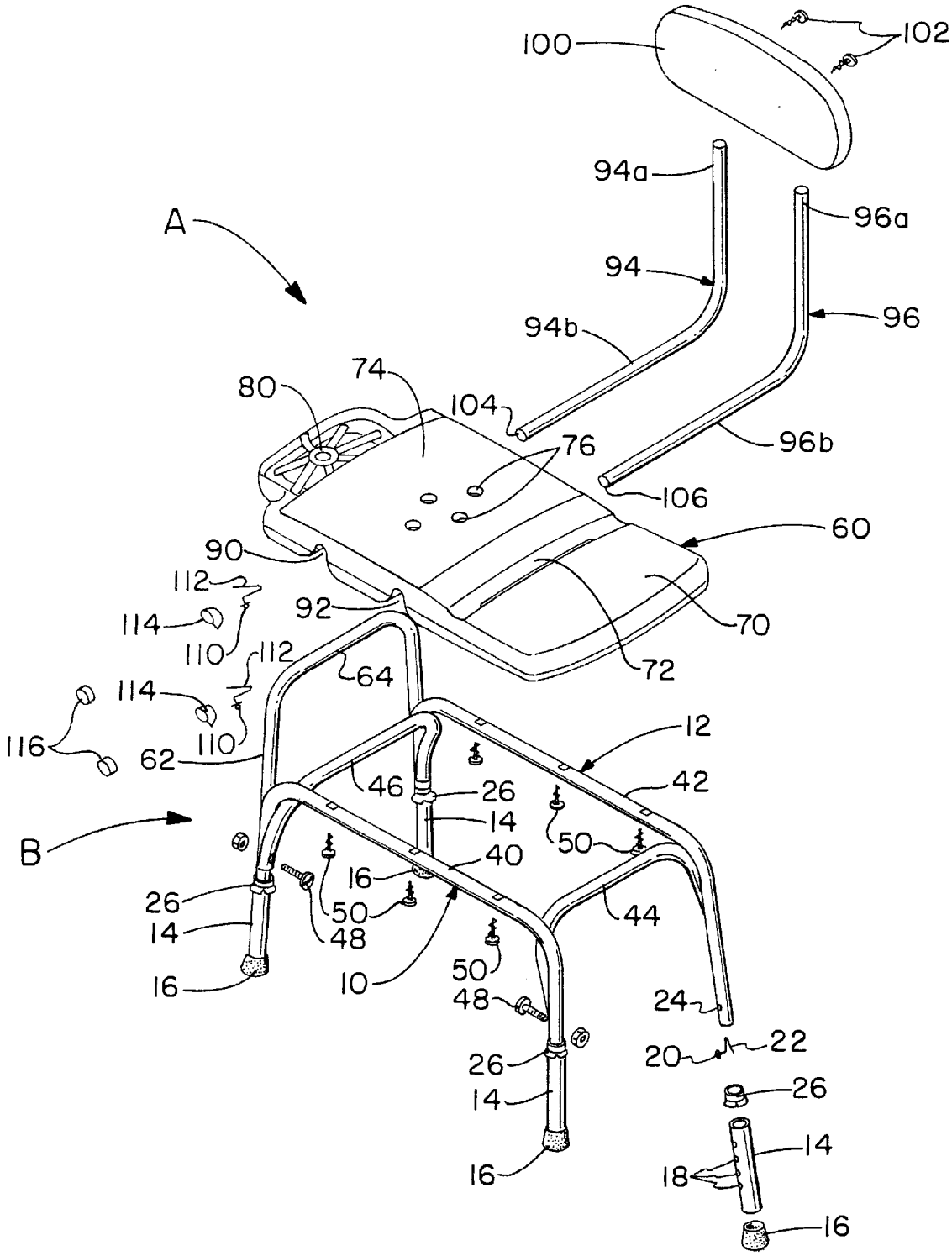
FIG. 1 is an exploded perspective view of a transfer bench formed in accordance with the teachings of the subject invention.

Referring now to the drawings wherein the showings are for the purposes of illustrating the preferred embodiment of the invention only and not for purposes of limiting same, the FIGURES show a transfer bench A adapted for at least partial receipt in a bathtub. More particularly, and with reference to FIG. 1, the transfer bench includes a frame assembly B which, in the preferred embodiment, is a metal tubular construction such as aluminum tubes bent to desired configurations and interconnected to form a frame assembly. In the preferred arrangement a pair of inverted, generally U-shaped tube members define front and rear bench legs 10, 12, respectively. The bench legs are substantially identical in construction unless noted to the contrary.

Each terminal end of the bench legs is adapted to receive a leg extension 14, one of which is shown detached from the bench leg end, although it will be understood that all four ends of the bench legs receive leg extension. Preferably, each leg extension is a tubular construction having a diameter slightly greater than the diameter of the bench legs so that it is slidably received thereover. Further, a crutch tip 16 caps the lower end of the leg extension to provide a non-slip rubber end. Each leg extension preferably includes a series of axially spaced openings 18 through which extends a snap button 20 biased outwardly by spring 22 through an opening 24 in the terminal end of each bench leg. Accordingly, when one of the leg extension openings 18 is aligned over opening 24, the snap button is biased radially outward and maintains the leg extension at the desired height. An anti-rattle collar 26 is also preferably received in the inner end of the leg extension and slides over the outer diameter of each terminal end of the bench legs. As the term connotes, the anti-rattle collar limits relative movement between the leg extension and the bench leg, and provides a secure fit therebetween.

Elongated central portions 40, 42 of the front and rear bench legs 10, 12, respectively, define a seat support surface when the frame is assembled. The bench legs are preferably held in parallel relation by a pair of end rails 44, 46. The end rails are secured at opposed ends to the terminal end portions of each bench leg 10, 12. Fasteners, such as a nut and bolt assembly, provide a secure connection between the end rails and bench legs. As is also shown in FIG. 1, a series of openings are spaced along central portions 40, 42 of the bench legs. These openings receive fasteners, such as sheet metal screws 50 or the like, to secure seat portion 60 to the central portions of the front and rear bench legs. As shown, four fasteners are used to fixedly secure the seat to each bench leg of the frame assembly, although a different number could be used without departing from the scope and intent of the subject invention. It is intended, however, that a relatively permanent connection is provided between the frame assembly and the seat. Thus, and as apparent from the later FIGURES, as the transfer bench leaves the manufacturing plant, the seat is secured to the frame assembly.

Also secured to the frame assembly is a handrail 62. It, too, is a metal tubular construction of having an inverted, generally U-shaped member in which its outer legs are fixedly secured to the front and rear bench legs, respectively. Again, suitable fasteners can be employed and in a preferred arrangement, the same nut and screw assembly that secures the end rail 46 to the front and rear bench legs also extends through the handrail 62. The handrail is preferably dimensioned so that a central portion 64, generally disposed in a horizontal relation, is positioned substantially above the plane that receives the seat portion 60. This allows the user to easily grasp the handrail to facilitate movement into and out of the bathtub by sliding along the upper surface of the seat portion.

The seat portion 60 is preferably a one-piece plastic construction. This is advantageous when compared to the known use of multiple components to form the seat portion since additional molding of the components is necessary, as well as the difficulties associated with inventory of separate components and the like. The preferred configuration of the seat portion is shown in FIG. 1 and has three distinct portions. A first end portion 70 defines the receiving area for the user/patient. It is preferably located furthest from the handrail and defined by a smooth upper surface slightly inclined relative to horizontal, that is downwardly, as it proceeds toward the handrail. A groove 72 separates this first end portion 70 from central seating area 74.

In the preferred embodiment, the central seating area includes through holes 76 that serve as drainage openings to allow water to freely pass through the seat portion. It will be additionally understood, however, that the central seating area has a generally crowned upper surface that also facilitates runoff of water.

The third portion of the seat portion is defined by an integrally molded tray or soap holder. It includes a central opening 80 that is adapted to receive, for example, a neck portion of a shower head disposed on a flexible hose. Spoked-shaped ribs extend outwardly from the opening 80 and are sloped toward the opening, again, to facilitate water drainage. Additionally, the soap holder is located inwardly of seat portion 74 so that it is always situated within the tub. Thus, no matter how the seat back is situated, the soap dish is always located within the tub. Of course, still other configurations of the seat portion may be adopted without departing substantially from the scope and intent of the subject invention.

A pair of recesses 90, 92 are provided in a lower surface of the seat portion. These recesses, when the seat portion is mounted on the frame assembly, define through openings extending from the front bench leg to the rear bench leg. It will be understood that the openings could be formed entirely within the seat portion, if so desired, or the opening defined, in whole or in part, by recessed areas in the frame assembly. In any event, a pair of openings are thereby defined and adapted to receive seat back mounting members 94, 96, respectively.

The seat back mounting members are also preferably of tubular construction and in a preferred embodiment, are generally L-shaped. Thus, first or vertical leg portions 94*a*, 96*a* are fixedly secured to seat back 100 via fasteners 102. Second or horizontal leg portions 94*b*, 96*b* of the seat back mounting members are of sufficient length to extend entirely through the openings 90, 92. In this manner, outer terminal ends 104, 106 of the second leg portions extend outwardly from the front or rear bench leg, depending on the orientation of the seat back. Each terminal end receives a snap button 110 biased outwardly by spring 112 to preclude removal of the seat back once the second leg portions have been advanced entirely through the openings. That is, the snap buttons are urged radially outward to define removable connections that interfere or abut with the edge of the seat portion/frame assembly unless depressed radially inward. Of course, other removable connectors such as quarter-turn fasteners or the like, that do not require a dealer/end user to use tools to assemble the transfer bench can be used without departing from the scope and intent of the subject invention. A pair of retaining clips 114 are received outwardly of the snap buttons to provide an aesthetic appearance to the terminal ends of the second leg portions and caps 116 are received over the terminal ends, again, primarily for aesthetic purposes.

Figure 2:
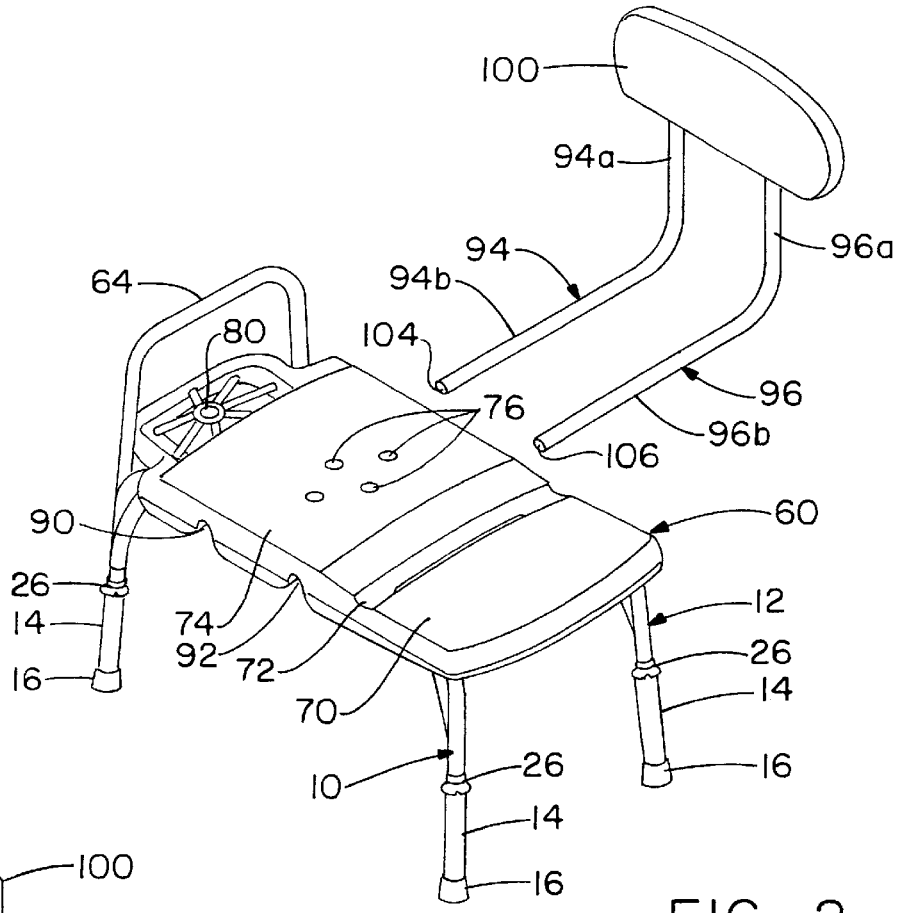
FIG. 2 is a perspective view illustrating the transfer bench with the seat back removed and capable or being mounted for either right-handed or left-handed application.

The seat back 100 is fixedly secured to the support members 94, 96. Thus, during shipment from the manufacturer, the frame assembly B and seat portion 60 define one component of the transfer bench, and the seat back 100 and support members 94, 96 define a second component (FIG. 2). These components can then be easily assembled by an end user merely by advancing the leg portions 94*b*, 96*b* through the openings in the seat portion. No tools are required to assemble the first component (frame assembly and seat portion) to the second component (seat bank and support members).

Figure 4:
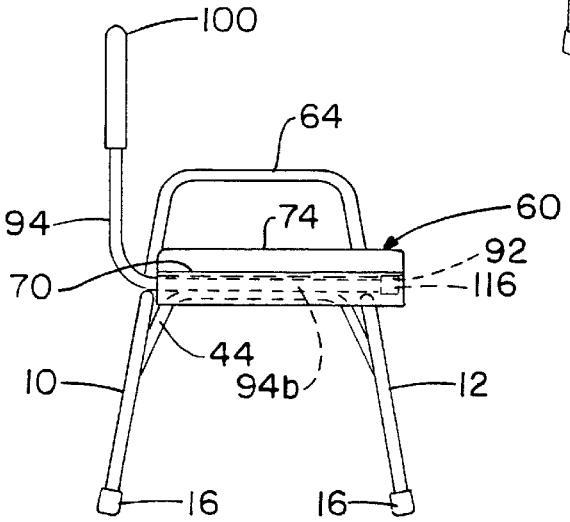
FIG. 4 is an elevational view similar to FIG. 3 but showing the seat back in a different or reversed position.
Figure 3:
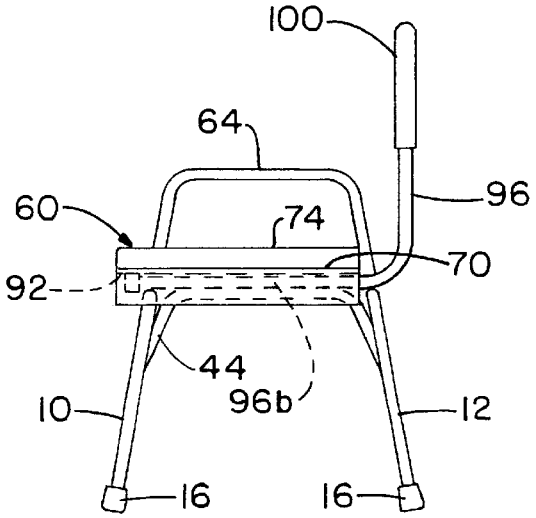
FIG. 3 is an elevational view of the assembled transfer bench.

As apparent from FIGS. 3 and 4, the second leg portions 94*b*, 96*b* may be received into openings 90, 92, respectively, or through openings 92, 90, respectively, depending on whether the transfer bench is adapted for a right-hand or left-hand bathtub. The user need only depress the snap button to advance the second leg portions through the openings until the snap buttons spring outwardly due to the spring bias. Thereafter, the retaining clips 114 are mounted on the terminal ends of the support members once the seat back has been positioned in place. Likewise, if it is desired to reverse the orientation of the seat back, the clips are easily removed from the terminal ends of the second leg portions, the seat back removed, and reversed for insertion through the openings in the opposite direction.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. A transfer bench comprising:

a tubular frame assembly adapted for at least partial receipt in an associated bathtub;

a seat having a seat portion disposed in generally fixed relation relative to the frame assembly, the seat portion having openings extending therethrough; and a seat back removable connected to the seat portion for reversibly mounting the seat back to the seat portion depending on whether the bathtub is a right-hand or left-hand bathtub, the seat back being secured to upright, first leg portions of first and second generally L-shaped tubular members, and second leg portions of the first and second L-shaped tubular members being adapted for receipt through the openings in the seat portion, wherein the second leg portions each include biased snap buttons that selectively retract inwardly as the second leg portions are advanced through the seat portion openings and protrude radially outward once the snap buttons have advanced past the seat portion to removably fix the seat back in place relative to the seat portion.

2. The transfer bench as defined in claim 1 wherein the seat portion is a one-piece plastic construction.

3. The transfer bench as defined in claim 1 wherein the frame assembly includes a pair tubular members disposed in generally horizontal arrangement and four legs depending downwardly therefrom.

4. The transfer bench as defined in claim 3 wherein the frame assembly further includes a hand rail extending upwardly from one side of the seat portion.

5. The transfer bench as defined in claim 3 wherein the legs are individually length adjustable to selectively increase and decrease the height of the seat portion.

6. The transfer bench as defined in claim 1 further comprising a pair of generally L-shaped members having first leg portions that receive the seat back and second leg portions that extend through openings in the seat portion, each second leg portion including a snap button that is biased radially outward by a spring to extend outwardly and hold the seat back in position relative to the seat portion once the second leg portion is received through the seat portion opening and may be deflected radially inward as the second leg portion is advanced or retracted through the opening during installation or removal of the seat back.

7. A transfer bench adapted for use in an associated bathtub, the transfer bench comprising:

a tubular frame assembly including four legs and a pair of support rails;

a seat portion rigidly secured to the support rails, the seat portion having a pair of recesses that define openings when the seat portion is received over the support rails;

a seat back;

first and second generally L-shaped members, each L-shaped member including first leg portions that are secured to the seat back and second leg portions which are adapted for receipt through the openings I the seat portion, the second leg portions further including snap buttons biased outwardly by spring-like members to engage the seat portion and preclude removal of the seat back from the seat portion once the L-shaped members have been advanced through the openings until the snap buttons are retracted against the bias of the spring members, wherein the seat back and the L-shaped members are reversible relative to the seat portion.

8. The transfer bench as defined in claim 7 wherein the seat portion is of plastic construction.

9. The transfer bench as defined in claim 8 wherein the seat portion is a one-piece construction.

10. The transfer bench as defined in claim 7 further comprising a hand rail extending upwardly from one side of the frame assembly.

11. The transfer bench as defined in claim 7 wherein the legs are selectively extendible to different lengths to vary the height of the seat portion relative to the bathtub.

12. The transfer bench as defined in claim 7 further comprising first and second clips received over terminal end portions of the second leg portions of the, L-shaped members, respectively.

* * * * *